US008043102B2

(12) United States Patent
Lu et al.

(10) Patent No.: US 8,043,102 B2
(45) Date of Patent: Oct. 25, 2011

(54) CONNECTOR SHEATH AND CABLE CONNECTOR ASSEMBLY HAVING SAME

(75) Inventors: Huo Ying Lu, Shanghai (CN); Qi Su, Shanghai (CN)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/677,673

(22) PCT Filed: Aug. 28, 2008

(86) PCT No.: PCT/US2008/074599

§ 371 (c)(1),
(2), (4) Date: Mar. 11, 2010

(87) PCT Pub. No.: WO2009/035859

PCT Pub. Date: Mar. 19, 2009

(65) Prior Publication Data

US 2010/0200265 A1 Aug. 12, 2010

(30) Foreign Application Priority Data

Sep. 11, 2007 (CN) ..... 2007 1 0148783

(51) Int. Cl.
*H01R 13/53* (2006.01)

(52) U.S. Cl. ..... 439/181; 439/921

(58) Field of Classification Search ..... 439/181, 439/921, 182–187

See application file for complete search history.

(56) References Cited

U.S. PATENT DOCUMENTS 3,888,559 A * 6/1975 Geib ..... 439/258
4,053,702 A 10/1977 Erickson et al.
4,571,018 A 2/1986 Annoot
4,629,277 A 12/1986 Boettcher et al.
4,714,438 A 12/1987 Williams
5,230,640 A 7/1993 Tardiff
5,756,936 A 5/1998 Viebranz et al.
6,796,820 B2 9/2004 Jazowski et al.
6,905,356 B2 6/2005 Jazowski et al.
6,991,484 B2 1/2006 Luzzi (Continued)

FOREIGN PATENT DOCUMENTS

CN 2566511 8/2003

(Continued)

OTHER PUBLICATIONS

"Silicon Rubber Graded Construction for High Voltage Insulation", Nizinski, S.J. for Down Corning Corp, Midland, MI, 1961, [retrieved from internet on Aug. 1, 2011], URL <http://oai.dtic.mil/oai/oai?verb=getRecord&metadataPrefix=html&identifier=AD0656174>.

(Continued)

*Primary Examiner* — Gary F. Paumen
(74) *Attorney, Agent, or Firm* — Melanie G. Gover

(57) ABSTRACT

The present invention discloses a connector sheath (1) adapted to be used in a cable connector assembly, comprising a T-shaped main insulation bushing (102), an inner semiconductive shield layer (105) disposed in the T-shaped main insulation bushing and integrally formed with the T-shaped main insulation bushing; and an outer semi-conductive shield layer (101) disposed on an outer surface of the T-shaped main insulation bushing and integrally formed with the T-shaped main insulation bushing. The T-shaped main insulation bushing is generally made of an elastic insulation material having a dielectric constant value in the range from about 5 to about 15. The present invention also discloses a cable connector assembly having a connector sheath.

10 Claims, 4 Drawing Sheets

U.S. PATENT DOCUMENTS

| | | | |
|---|---|---|---|
| 7,104,822 | B2 | 9/2006 | Jazowski et al. |
| 7,431,599 | B2 | 10/2008 | Luzzi |
| 2005/0227522 | A1 | 10/2005 | Luzzi |
| 2010/0279543 | A1 | 11/2010 | Nguyen et al. |

FOREIGN PATENT DOCUMENTS

| | | |
|---|---|---|
| DE | 4432542 | 3/1996 |
| EP | 0422567 | 4/1991 |
| EP | 0780949 | 6/1997 |
| EP | 0911936 | 4/1999 |
| JP | 2000-312430 | 11/2000 |
| WO | WO 9531845 | 11/1995 |
| WO | WO 2009006136 | 1/2009 |

OTHER PUBLICATIONS

Gunasekaran, S. et al., "Dielectric studies of some rubber materials at microwave frequencies", Indian Journal of Pure and Applied Physics, vol. 46, Oct. 2008, pp. 733-737.

* cited by examiner

CONNECTOR SHEATH AND CABLE CONNECTOR ASSEMBLY HAVING SAME

CROSS REFERENCE TO RELATED APPLICATIONS

This application is a national stage filing under 35 U.S.C. 371 of PCT/US2008/074599, filed Aug. 28, 2008, which claims priority to Chinese Application No.200710148783.8, filed Sep. 11, 2007, the disclosure of which is incorporated by reference in its/their entirety herein.

FIELD OF THE INVENTION

This invention relates to cable accessories used in the power cable work, and in particular, to a connector sheath and a cable connector assembly having the same. More particularly, the present invention relates to a detachable T-shaped power cable connector.

BACKGROUND

With the development and further expansion of electric power grids and the increasing desire to locate portions of the electric cable system underground, demand for power cables used under medium voltage (i.e., in the range of about 6 to about 24 kV) is rapidly increasing. At the same time, the demand for power cable accessories associated with medium voltage power cables is accordingly also increasing.

A detachable T-shaped cable connector assembly (hereinafter simply referred to as T-shaped cable connector assembly) is one such power cable accessory. A T-shaped cable connector assembly includes a T-shaped connector sheath. The T-shaped connector sheath generally comprises: a T-shaped main insulation bushing; an inner semi-conductive shield layer disposed in the T-shaped main insulation bushing and integrally formed with the T-shaped main insulation bushing; and an outer, semi-conductive shield layer disposed on an outer surface of the T-shaped main insulation bushing and integrally formed with the T-shaped main insulation bushing. To control the electric field distribution at the shield end of the cable, an adapter in which an electric stress control layer is imbedded needs to be connected during usage of the cable connector. The manufacturing process of the connector sheath with the adapter is complicated and has a high cost. Moreover, a unique type of connector sheath has to be used with the cable to correspond to a particular cable cross section. The connector sheath therefore has generally poor versatility, and it can be difficult to mount the cable.

For example, a European Patent Application Publication No. EP911936(A1) discloses a T-shaped cable connector assembly. According to the publication, a stress control cone is imbedded in the main insulation bushing of the T-shaped connector sheath for controlling the electric field distribution at the shielding end of the cable. The connector sheath must correspond, or match, the cable cross section. The versatility of the connector sheath is poor, and the cable is difficult to mount in the connector sheath.

In U.S. Patent Application Publication No. US20050227522(A1), a T-shaped "cold-shrink" cable connector assembly is disclosed. The publication employs a "cold-shrink" process and solves the difficulty of mounting the cable into the cable connector sheath. However, the patent uses the outer shield layer as the stress control layer for the shielding end of the cable. For that reason, the outer shield layer must be designed into a tapered or flaring shape and, the manufacturing process is complicated and the waste product rate is high. Thus, although the above patent has to at least some degree solved the difficulty attendant with mounting the cable, it suffers from other defects.

SUMMARY

It is desirable to design a novel T-shaped cable connector that can solve the difficulty associated with mounting, enjoys a simpler manufacturing process, and can be used with a range of cable cross sectional dimensions.

According to one aspect of the present invention, a connector sheath is provided, which is adapted to be used in a cable connector assembly, comprising: a T-shaped main insulation bushing, an inner semi-conductive shield layer disposed in the T-shaped main insulation bushing and attached to the T-shaped main insulation bushing; and an outer semi-conductive shield layer disposed on an outer surface of the T-shaped main insulation bushing and attached to the T-shaped main insulation bushing, wherein the T-shaped main insulation bushing is made of an elastic insulation material, and the dielectric constant value of the elastic insulation material is in the range from about 5 to about 15.

With the connector sheath according to the present invention, because the T-shaped main insulation bushing in the connector sheath is made of an elastic insulation material, a "cold-shrink" process can be used to mount the cable. At the same time, because the T-shaped main insulation bushing in the connector sheath has elasticity, it can be adapted to cables with cross sections of different and varied dimensions.

Another aspect of the invention provides a cable connector assembly adapted to connect a cable bonded to an end of a cable lug to an external electrical apparatus. The assembly generally comprises the connector sheath according to the above-described embodiment of the invention wherein the connector sheath is a T-shaped bushing comprising: (a) an electrical apparatus connecting chamber disposed at a first end of the T-shaped bushing, where the electrical apparatus connecting chamber is adapted to accommodate an external electrical apparatus connection part; (b) a cable lug chamber and a cable connecting chamber successively disposed at a second end of the T-shaped bushing, where the cable lug chamber is adapted to accommodate the cable lug and the cable connecting chamber is adapted to accommodate a cable; and (c) a connecting assembly for electrically connecting the other end of the cable lug to the external electrical apparatus connection part.

DETAILED DESCRIPTION

Figure 1:
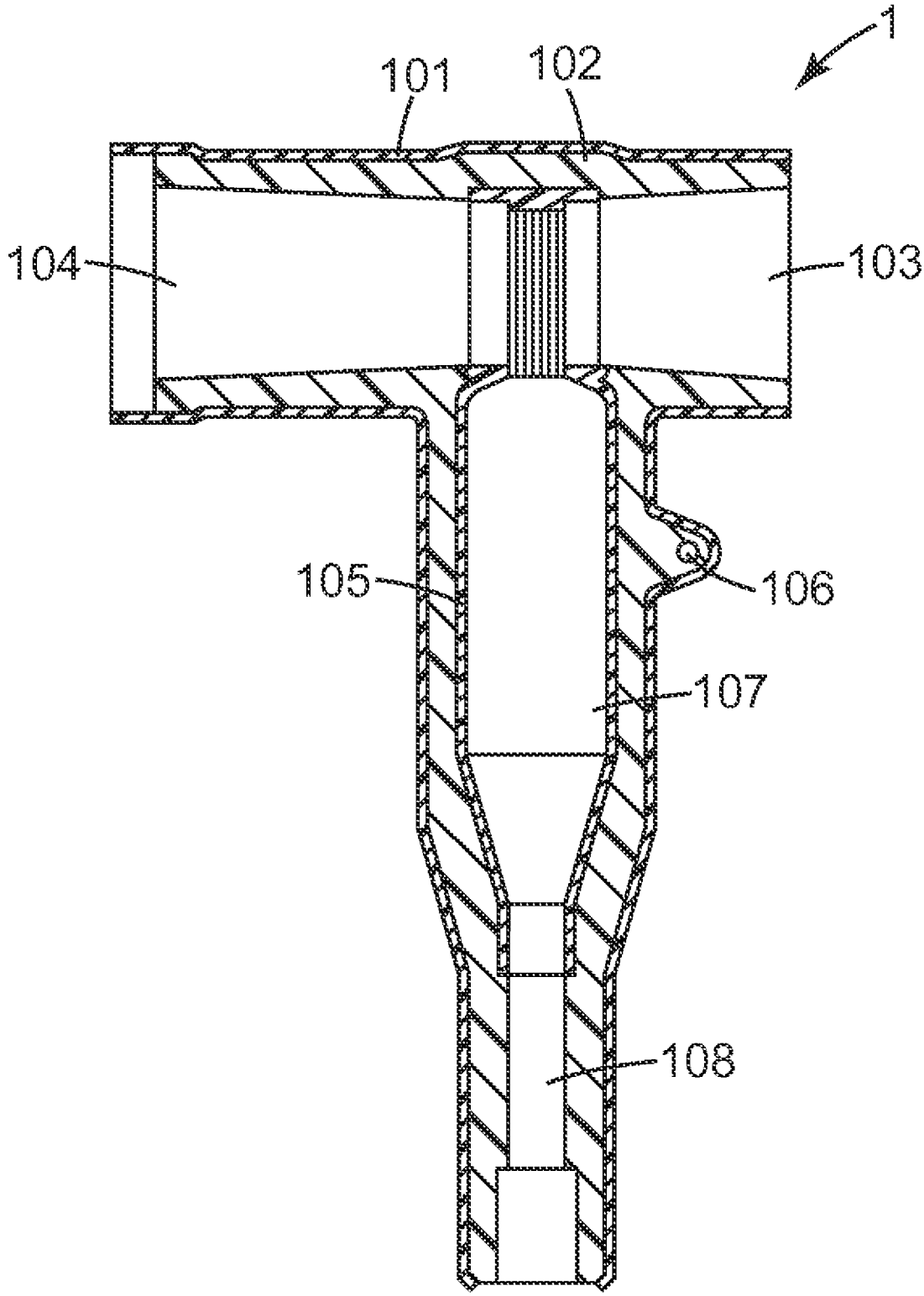
FIG. 1 is a view showing the structure of a T-shaped connector sheath according to one embodiment of the present invention.

Preferred embodiments of the present invention will be described hereinafter in detail with reference to the attached drawings, wherein the like reference numerals refer to the like elements throughout the specification. The present invention may, however, be embodied in many different forms and should not be construed as being limited to the illustrative embodiments set forth herein.

FIG. 1 is a view showing the structure of a T-shaped connector sheath according to an embodiment of the present invention. The T-shaped connector sheath 1 comprises an outer semi-conductive shield layer 101, a T-shaped main insulation bushing 102, an insulation plug chamber 103, an electrical apparatus connecting chamber 104, an inner semi-conductive shield layer 105, a grounding hole 106, a cable lug chamber 107 and a cable connecting chamber 108. As shown in FIG. 1, the insulation plug chamber 103, the electrical apparatus connecting chamber 104, the cable lug chamber 107 and the cable connecting chamber 108 constitute a T-shaped chamber inside the T-shaped connector sheath 1.

In particular, as shown in FIG. 1, the T-shaped connector sheath comprises three layers, that is, the outer semi-conductive shield layer 101, the T-shaped main insulation bushing 102 and the inner semi-conductive shield layer 105. The T-shaped main insulation bushing 102 comprises a horizontally extended portion (left and right direction in FIG. 1) and a vertical extended portion that is extended perpendicularly from the midway of the horizontally extended portion (the up and down direction in FIG. 1). The T-shaped main insulation bushing 102 defines a T-shaped chamber therein and comprises a horizontal chamber and a vertical chamber. The outer semi-conductive shield layer 101 is disposed on the outer surface of the T-shaped main insulation bushing 102 and covers the outer surface of the T-shaped main insulation bushing 102 completely. The inner semi-conductive shield layer 105 is disposed in the T-shaped main insulation bushing 102 and attached to the T-shaped main insulation bushing 102. The inner semi-conductive shield layer 105 is extended from the midway of the vertical chamber of the T-shaped main insulation bushing 102 to the top portion of the horizontal chamber. The length of the inner semi-conductive shield layer 105 is less than the vertical length of the T-shaped main insulation bushing 102.

The T-shaped connector sheath 1 may, for example, be manufactured by injection molding or press molding. Specifically, the T-shaped connector sheath 1 of the present invention may be manufactured by the following process: firstly, the inner semi-conductive shied layer 105 is manufactured by injection molding or press molding; then the main insulation bushing is manufactured by injection molding or press molding the main insulation bushing material on the inner semi-conductive shied layer 105; finally, the outer semi-conductive shield layer 101 is manufactured by injection molding or press molding the outer semi-conductive shield layer material on the main insulation bushing. In the above process, the outer semi-conductive shield layer 101 may alternatively be manufactured by coating the outer semi-conductive shield layer material on the main insulation bushing.

Alternatively, the T-shaped connector sheath of the present invention may also be manufactured as follows: firstly, the inner semi-conductive shield layer 105 and the outer semi-conductive shield layer 101 are manufactures respectively by injection molding or press molding; then the main insulation bushing is formed by injection molding or press molding the main insulation bushing material between the inner and outer semi-conductive shield layers.

In the process for manufacturing the T-shaped connector sheath according to the present invention, the outer semi-conductive shield layer 101 may be formed by coating the outer semi-conductive shield layer material on the main insulation bushing. In contrast, the design of the T-shaped connector sheath according to U.S. Patent Application Publication No. US20050227522 (A1), employs the outer semi-conductive shield layer as a stress control layer. This layer must be joined to the shield end of the cable, and the tail portion of the outer semi-conductive shield layer must be extended beyond the main insulation bushing. For this reason, the outer semi-conductive shield layer must be manufactured by injection molding or press molding rather than by coating. Instead, the T-shaped connector sheath of the present invention can use simple coating processes. The number of molds can therefore be reduced, the process for manufacturing the T-shaped connector sheath can be simplified, and the manufactured yield can be increased.

As shown in FIG. 1, a first end of the horizontal chamber (see the left end of FIG. 1) of the T-shaped main insulation bushing 102 is the electrical apparatus connecting chamber 104 for connecting an external electrical apparatus. Another end of the horizontal chamber (see the right end of FIG. 1), which is opposite to the first end, of the T-shaped main insulation bushing 102 is the insulation plug chamber 103 for connecting an insulation plug. The vertical chamber comprises the cable lug chamber 107 and the cable connecting chamber 108. The cable lug chamber 107 is connected with the horizontal chamber to accommodate the cable lug. The cable connecting chamber 108 is disposed below the cable lug chamber 107 and connected with the cable lug chamber 107 to accommodate the cable.

The T-shaped main insulation bushing 102 is preferably made of an elastic insulation material having a dielectric constant value in the range of about 5 to about 15. According to one embodiment of the present invention, the elastic insulation material comprises silicon rubber or ethylene propylene terpolymer (EPT). The invention, however, is not limited to use of these particular materials. The elastic insulation material used for the main insulation bushing may be any material that meets a desired set of physical properties for its intended application, including preferably the above dielectric constant value range. For example, by using an elastic insulation material having the above dielectric constant value for the T-shaped main insulation bushing, the T-shaped main insulation bushing can meet the relevant requirements for power frequency voltage resistance as well as for partial discharge properties. It can also address the problem of electric field concentration at the shield end of the cable and exhibit good stress control effects while ensuring the insulation property of the T-shaped connector sheath. It is therefore not necessary to additionally provide a separate adapter or stress control layer for the connector sheath of the present invention. In one embodiment of the invention, the dielectric constant of the T-shaped main insulation bushing 102 is in the range of about 5 to about 10 for obtaining better stress control and insulation properties. More preferably, the dielectric constant of the T-shaped main insulation bushing 102 is set to be approximately 7.

According to the present invention, since it is not necessary to provide a separate stress control layer or an adaptor, the manufacture process of the T-shaped connector sheath and the assembly of the T-shaped connector sheath and the other parts of the cable connector assembly can be simplified. The manufacture cost and production efficiency can also be improved.

Where the connector sheath 1 of the present invention is manufactured by elastic material, such as silicon rubber or ethylene propylene terpolymer (EPT), a "cold-shrink" process can be used for connecting the connector sheath 1 and the cable. Briefly, such a "cold-shrink" process may be employed essentially as follows: a T-shaped connector sheath may be expanded on a core reel in advance before being connected to a cable; then, when mounting a cable, the cable can be inserted into the cable inserting chamber of the core reel; then the core reel can be drawn out from the connector sheath leaving the cable clamped in the connector sheath. Because the connector sheath contracts automatically due to its elasticity after the core reel is drawn out, it clamps on the cable with a sustaining radial pressing force, so that the connection of the cable and the connector sheath can be completed.

Figure 2:
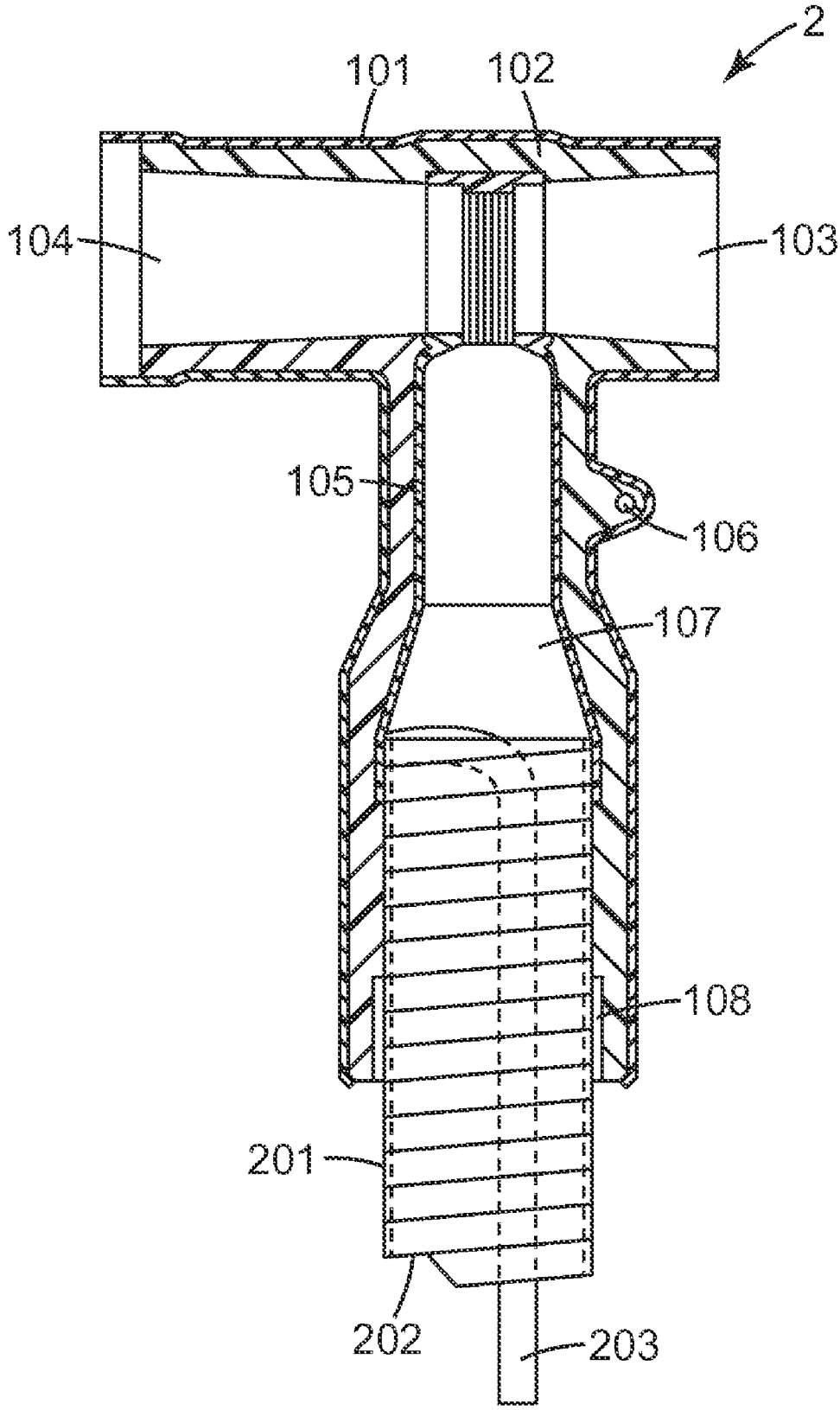
FIG. 2 is a view showing the T-shaped connector sheath into which a core reel has been inserted.

FIG. 2 is a schematic view showing the structure of the assembly 2 constituted by the T-shaped connector sheath 1 and the core reel 201 put in the connector sheath 1. The core reel 201 has a hollow structure with a predetermined rigidity. As shown in FIG. 2, the core reel 201 is inserted in the cable connecting chamber 108 of the T-shaped connector sheath 1 with a length larger than the cable connecting chamber 108. Therefore, the core reel 201 is projected out of the cable connecting chamber 108. The core reel 201 defines a cable inserting chamber 202 having an inner diameter larger than the outer diameter of the cable to facilitate the insertion of the cable. At one end of the core reel 201 is formed a core reel pulling end 203, which has sufficient length so that an operator can grasp the core reel pulling end 203 easily to withdraw the core reel 201 from the T-shaped connector sheath 1 after the cable is mounted into the expanded connector sheath.

Figure 3:
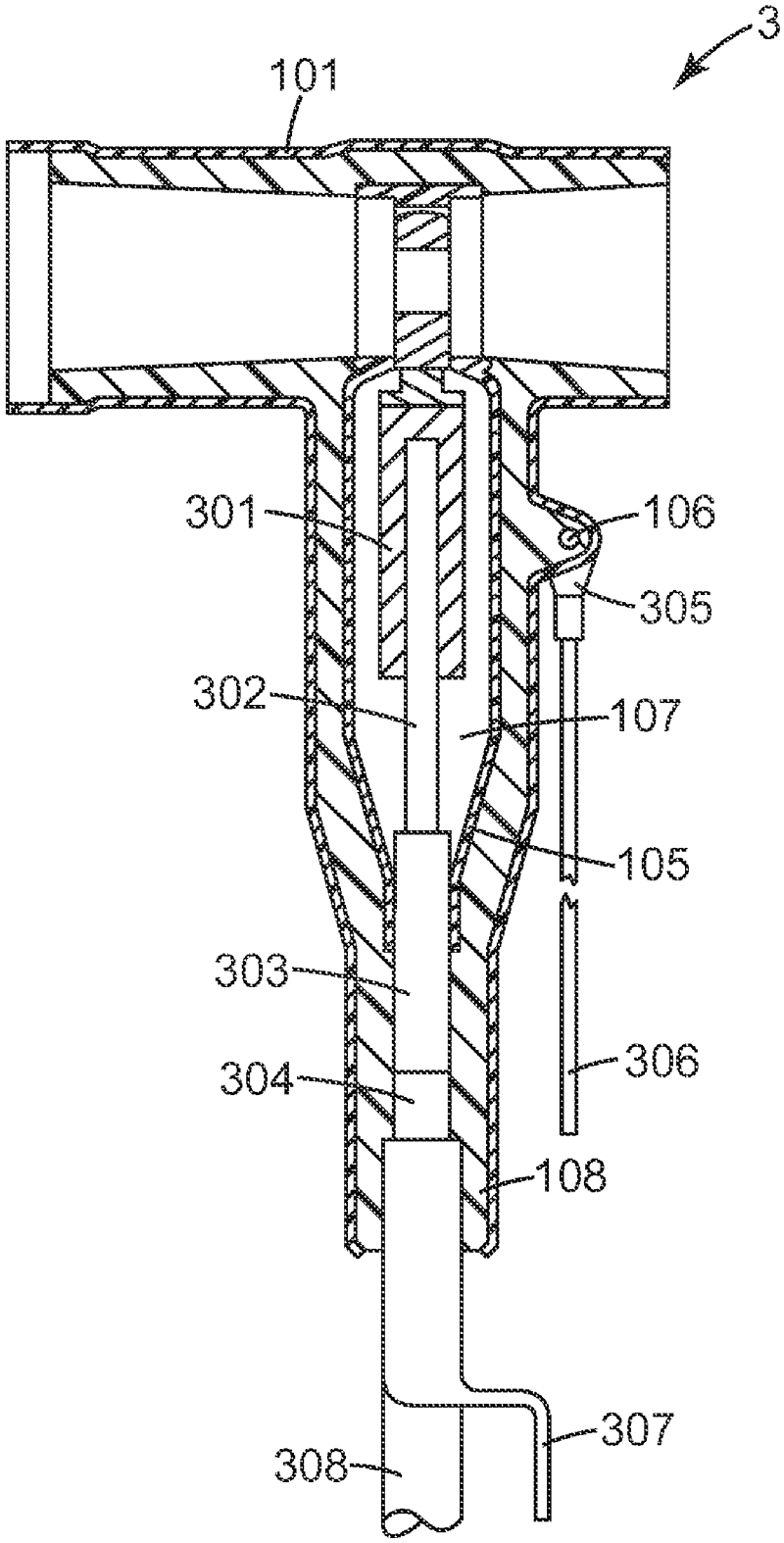
FIG. 3 is a view showing the structure for connecting the T-shaped connector sheath to cable.

FIG. 3 is a structural view showing an assembly 3 constituted by the T-shaped connector sheath 1 and the cable bond to the cable lug 301. The cable lug 301 is received in the cable lug chamber 107 with a length less than that of the inner semi-conductive shield layer 105. The cable lug 301 defines a deep hole inside it for receiving the cable conductor 302. The length of the cable conductor 302 is longer than the depth of the hole inside the cable lug 301. Therefore, a portion of the cable conductor 302 is exposed outside the cable lug 301 after mounting. The outer diameter of the cable conductor 302 is less than the diameter of the hole inside the cable lug 301 so that the cable lug 301 can be easily mounted on the cable conductor 302. The cable comprises the cable conductor 302, the cable insulation layer 303, the cable outer shield layer 304 and a cable copper shield layer 307 from the inner layer to the outer layer. The outer diameter of the cable insulation layer 303 is larger than the inner diameter of the cable connecting chamber 108 of the T-shaped connector sheath in an unexpanded state, so that the connector sheath can keep tight contact with the cable after the cable is connected.

The process for connecting the connector sheath 1 and the cable may be explained by referring to FIGS. 2 and 3. When manufactured in the factory, the T-shaped connector sheath 1 formed by injection molding or press molding is expanded on the core reel 201 so as to form the assembly 2 constituted by the T-shaped connector sheath 1 and the core reel 201 as shown in FIG. 2. When the cable is to be connected, firstly, the constituting layers of the cable 308 can be peeled off in order and the cable conductor 302, the cable insulation layer 303, the cable outer shield layer 304 and the copper shield layer 307 are exposed respectively as shown in FIG. 3. Then, the cable conductor 302 is inserted into the deep hole inside the cable lug 301 to be pressed together with the cable lug 301. Then the assembly of the cable 308 and the cable lug 301 is inserted into the cable inserting chamber 202 of the core reel 201 as shown in FIG. 2. Then, after fixing the cable, the core reel 201 is drawn out from the T-shaped connector sheath 1 by pulling the core reel pulling end 203. At this time, the connector sheath 1 contracts automatically due to its elasticity and presses against the cable with sustaining pressing force. In addition, one connector sheath type having a single specification can cover several types of cables with different cross sectional dimensions.

As shown in FIG. 3, after connecting the T-shaped connector sheath 1 and the cable, the boundary between the cable outer shield layer 304 and the cable insulation layer 303 should be located near or approximately at the middle of the cable connecting chamber 108 of the T-shaped cable connector sheath 1. As shown in FIG. 3, a thread connecting assembly 305 connects the grounding hole 106 and a grounding wire 306 so that the grounding wire 306 and the outer semi-conductive shield layer 101 can be connected.

Figure 4:
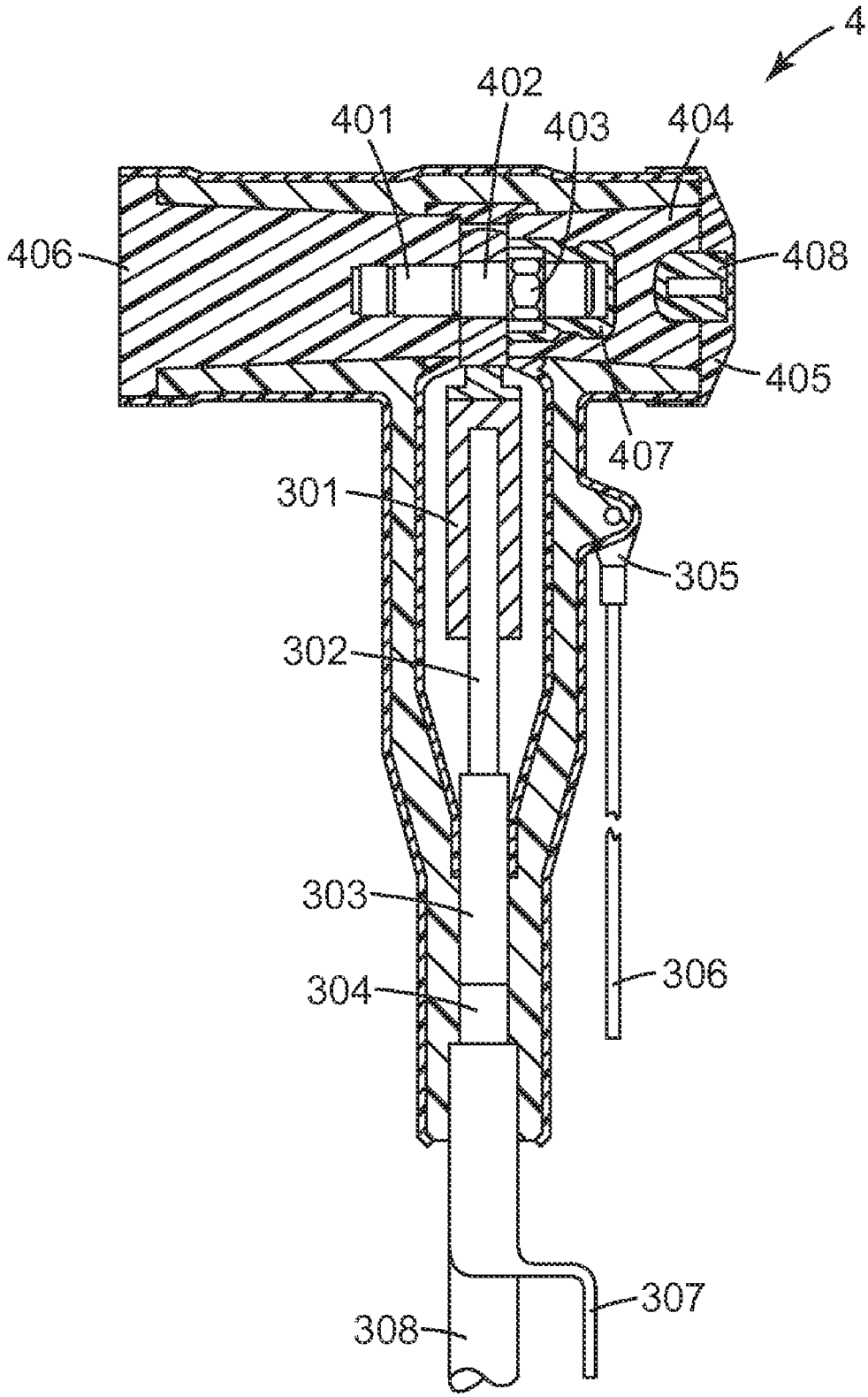
FIG. 4 is a view showing the structure for connecting a T-shaped cable connector assembly according to one embodiment of the present invention to a cable and an external electrical apparatus.

FIG. 4 is a view showing the structure of an assembly 4 formed by connecting a T-shaped cable connector assembly of the present invention with the cable and the external electrical apparatus. As shown in FIG. 4, a cable connector assembly of the invention comprises the T-shaped connector sheath 1 as shown in FIG. 1. The cable connector assembly may further comprise a thread connecting assembly constituted by a connecting bolt 401 and a connecting nut 403. The cable connector assembly may also comprise an insulation plug 404, a first embedded member 407 and a second embedded member 408 embedded in the insulation plug 404, and a semi-conductive shield tail plug 405.

As shown in FIG. 4, an electrical apparatus connecting part 406 and an insulation plug 404 together define a bolt connecting chamber 402. A connecting bolt 401 and a connecting nut 403 are disposed in the bolt connecting chamber 402 to connect one end of the cable lug 301 with the external electric apparatus connecting part 406. The present invention is not limited to this. Other connecting means may be used for connecting the cable lug and the external electrical apparatus connecting part. The other end of the cable lug 301 is connected with a cable 308. A first embedded member 407 and a second embedded member 408 may be provided inside the insulation plug 404. The electrical apparatus connecting part 406 is fitted in the electrical apparatus connecting chamber 104 of the T-shaped main insulation bushing 1. The insulation plug 404 is fitted in the insulation plug chamber 103 of the T-shaped main insulation bushing 1.

The process for connecting the cable connector assembly with the external electrical apparatus may be explained by reference to FIG. 4.

When connecting the assembly 3 of the T-shaped cable connector assembly 1 and the cable with the electrical apparatus, firstly, the cable lug 301 is fixed to the electrical apparatus connecting part 406 by the thread connecting assembly constituted by the connecting bolt 401 and the connecting screw 403. Specifically, the connecting bolt 401 is firstly passed through an end of the cable lug 301 which is opposite to the end connected to the cable. Next, the end of the connecting bolt 401 passing through the cable lug 301 is connected (by threading) with the electrical apparatus connecting part 406. Then, the other end of the connecting bolt 401 is connected with the connecting nut 403 to fasten the cable lug 301 on the external electrical apparatus connecting part 406.

After fastening the cable lug 301 to the external electrical apparatus connecting part 406 by the thread connecting assembly, the insulation plug 404 and the connecting bolt 401 are connected by the first embedded member 407. The second embedded member 408 is embedded in the first end (left end in the FIG. 4) of the insulation plug 404, and the first embedded member 407 has a threaded hole therein to engage the other end of connecting bolt 401. In this way insulation plug 404 and connecting bolt 401 can be connected together. Second embedded member 408 is embedded in the second end of the insulation plug 404 (right end in FIG. 4) and used for the operating member when the insulation plug 404 is fitted. That is, the operator screws the second embedded member 408 to fit the insulation plug 404 into the insulation plug chamber 103 of the T-shaped main insulation bushing 1.

After the insulation plug 404 is fitted, a semi-conductive shield tail plug 405 is mounted on the second embedded member 408 of the insulation plug 404 so that the second imbedded member 408 of the insulation plug 404 is connected to the outer semi-conductive shield layer 101 of the T-shaped connector sheath 1. Thus, the assembly of the cable connector assembly of the present invention and the electrical apparatus are completed.

The T-shaped connector sheath of the T-shaped cable connector assembly according to the present invention may employ a "cold-shrink" process. The main insulation bushing of the T-shaped connector sheath may be made of elastic material by injection molding or press molding on the inner semi-conductive shield layer. In particular, the dielectric constant value of the insulation elastic material can be in the range of about 5 to about 15, which can effectively address the problem relating to the electric field concentration at the end of a 6-24 kV cable, and the problem that the existing T-shaped connector sheath requires a stress control layer inside the main insulation bushing. Also, the T-shaped cable connector assembly of the invention can solve the problem that the outer shield layer of the T-shaped connector sheath has to be made into a complicated tapered or flaring shape.

Examples

The following tables list the results of power frequency voltage resistance tests and partial discharge property tests for a T-shaped main insulation bushing having different dielectric constant values according to several embodiments of the present invention.

Test 1:

A T-shaped connector sheath in which silicon rubber with dielectric constant value of approximately 5 was used for a T-shaped main insulation bushing with a thickness of about 12 mm. The T-shaped connector sheath was mounted to a cable with a cross sectional area of about 185 $mm^2$, made of cross-linked polyethylene and with a voltage class of 8.7/15 kV. The test background (environment interference) was <1 pC. The test results for the samples follow in Table 1.

TABLE 1

| Sample | AC voltage resistance 39 kV | 15 kV |
|---|---|---|
| 1 | 30 minutes, no breakdown | <1 pC |
| 2 | 30 minutes, no breakdown | <1 pC |
| 3 | 30 minutes, no breakdown | <1 pC |

Test 2:

A T-shaped connector sheath in which silicon rubber with a dielectric constant value of about 7 was used for the T-shaped main insulation bushing with a thickness of about 12 mm. The T-shaped connector sheath was mounted to a cable with a cross sectional area of about 185 $mm^2$, made of cross-linked polyethylene and with a voltage class of 8.7/15 kV. The test background (environment interference) was <1 pC. The test results for the samples follow in Table 2.

TABLE 2

| Sample | AC voltage resistance 39 kV | 15 kV |
|---|---|---|
| 4 | 30 minutes, no breakdown | <1 pC |
| 5 | 30 minutes, no breakdown | <1 pC |
| 6 | 30 minutes, no breakdown | <1 pC |

Test 3:

A T-shaped connector sheath in which silicon rubber with a dielectric constant value of about 15 was used for the T-shaped main insulation bushing with a thickness of about 12 mm. The T-shaped connector sheath was mounted to a cable with a cross sectional area of about 185 $mm^2$, made of cross-linked polyethylene and with a voltage class of 12/20 kV. The test background (environment interference) was <1 pC. The test results for the samples follow in Table 3.

TABLE 3

| Sample | AC voltage resistance 54 kV | 24 kV |
|---|---|---|
| 7 | 30 minutes, no breakdown | <1 pC |
| 8 | 30 minutes, no breakdown | <1 pC |
| 9 | 30 minutes, no breakdown | <1 pC |

From the above examples, it can be seen that all exemplified T-shaped connector sheathes met relevant requirements in power frequency voltage resistance and partial discharge properties.

Although several preferred embodiments have been shown and described, it would be appreciated by those skilled in the art that changes may be made in these embodiments without departing from the principles and spirit of the invention, the scope of the which is defined in the claims and their equivalents.

What is claimed is:

1. A connector sheath adapted to be used in a cable connector assembly, comprising:

a T-shaped main insulation bushing, an inner semi-conductive shield layer disposed in the T-shaped main insulation bushing and attached to the T-shaped main insulation bushing; and an outer semi-conductive shield layer disposed on an outer surface of the T-shaped main insulation bushing and attached to the T-shaped main insulation bushing, wherein the T-shaped main insulation bushing is made of an elastic insulation material having a dielectric constant value in the range from about 5 to about 15 such that the connector sheath provides electrical stress control for 6 to 24 kV cables without a separate adapter, stress control layer, or geometric stress cone.

2. The connector sheath according to claim 1, wherein the dielectric constant value of the elastic insulation material is in the range from about 5 to about 10.

3. The connector sheath according to claim 1, wherein the T-shaped main insulation bushing is formed by injection molding or press molding.

4. The connector sheath according to claim 1, wherein the T-shaped main insulation bushing is made of silicon rubber or ethylene propylene terpolymer.

5. The connector sheath according to claim 1, further comprising a core reel adapted to internally support and expand an end of the cable connecting chamber of the connector sheath for facilitating the insertion of a cable, wherein the core reel is adapted to be withdrawn from the cable connecting chamber of the connector sheath after the connection of the cable.

6. A cable connector assembly adapted to connect a cable bonded to an end of a cable lug to an external electrical apparatus, comprising a connector sheath according to claim

1, wherein the connector sheath is a T-shaped bushing comprising:

an electrical apparatus connecting chamber disposed at a first end of the T-shaped bushing, wherein the electrical apparatus connecting chamber is adapted to accommodate an external electrical apparatus connection part;

a cable lug chamber and a cable connecting chamber successively disposed at a second end of the T-shaped bushing, the cable lug chamber adapted to accommodate the cable lug, the cable connecting chamber adapted to accommodate a cable; and a connecting assembly for electrically connecting the opposite end of the cable lug to the external electrical apparatus connection part.

7. The cable connector assembly according to claim 6, further comprising:

an insulation plug chamber disposed at a third end of the T-shaped bushing opposite to the first end; and an insulation plug adapted to be accommodated in the insulation plug chamber.

8. The cable connector assembly according to claim 6, wherein the connecting assembly comprises:

a connecting bolt passing through the opposite end of the cable lug, wherein one end of the connecting bolt is screwed to the external electrical apparatus connecting part; and a connecting nut for fastening the cable lug to the external electrical apparatus connecting part.

9. The cable connector assembly according to claim 8 further comprising:

a first embedded member embedded into a first end of the insulation plug and screwed to the opposite end of the connecting bolt; and a second embedded member embedded into a second end opposite to the first end of the insulation plug.

10. The cable connector assembly according to claim 9, further comprising:

a semi-conductive shield tail plug fitted in the second imbedded member and connecting the second embedded member to the outer semi-conductive shield layer of the T-shaped connector sheath.

* * * * *